US006019084A

United States Patent [19]

Haynes et al.

[11] Patent Number: 6,019,084

[45] Date of Patent: Feb. 1, 2000

[54] IDLE SPEED CONTROL ASSEMBLY

[75] Inventors: John Charlton Haynes; George Marion Brandon, both of Murfreesboro, Tenn.

[73] Assignees: Campbell Hausfeld; Scott Fetzer Company, both of Harrison, Ohio

[21] Appl. No.: 09/358,603

[22] Filed: Jul. 21, 1999

[51] Int. Cl.[7] ..... F02M 3/00

[52] U.S. Cl. ..... 123/339.13; 123/400; 123/339.27

[58] Field of Search ..... 123/339.13, 339.27, 123/400

[56] References Cited

U.S. PATENT DOCUMENTS

| | | | |
|---|---|---|---|
| 1,967,145 | 7/1934 | Fisher . | |
| 3,569,724 | 3/1971 | Kuehn et al. . | |
| 4,188,931 | 2/1980 | Waterhouse . | |
| 4,235,560 | 11/1980 | Schimmel . | |
| 4,395,985 | 8/1983 | Hagen | 123/339.27 |
| 4,502,436 | 3/1985 | Bonfiglioli . | |
| 5,186,142 | 2/1993 | Brunelli et al. | 123/339.16 |
| 5,726,503 | 3/1998 | Domanski et al. | 123/339.13 |
| 5,787,861 | 8/1998 | Suzuki et al. | 123/400 |

FOREIGN PATENT DOCUMENTS

| | | | |
|---|---|---|---|
| 57-105533 | 7/1982 | Japan | 123/339.13 |
| 58-91332 | 5/1983 | Japan | 123/339.13 |

OTHER PUBLICATIONS

Page numbered 578340326053–1 showing two photographs of the prior art apparatus described in the present patent application in the Background of the invention.

Copy of the present Assignee's Drawing No. GN001102AV, revised Jun. 1, 1998, showing a part that was ordered from a metal fabricator in Jun., 1998.

*Primary Examiner*—Erick R. Solis

*Attorney, Agent, or Firm*—Jones Day, Reavis & Pogue

[57] ABSTRACT

The present invention is an apparatus for controlling the idle speed of an internal combustion engine. The engine has a throttle linkage with a movable control member. The idle speed control apparatus includes a bracket, a bolt, a spring and a nut. An electrical coil on the bolt magnetizes the bolt when the coil is energized by electric current. The bolt can be advanced longitudinally toward the throttle control member under the bias of the spring by rotating the nut on the bolt in one direction, and can be retracted longitudinally from the throttle control member against a bias of the spring by rotating the nut on the bolt in the opposite direction.

6 Claims, 2 Drawing Sheets

IDLE SPEED CONTROL ASSEMBLY

BACKGROUND OF THE INVENTION

The present invention relates to the field of idle speed control for internal combustion engines.

A known assembly 10 for controlling the idle speed of an internal combustion engine shown partially in FIG. 1. The assembly 10 includes a bolt 12 with an electrical coil 14 for magnetizing the bolt 12. When the bolt 12 is magnetized, a movable part of an engine throttle linkage (not shown) is attracted into contact with the bolt head 16.

A bracket 20 supports the bolt 12 on the engine. A screw-threaded stem portion 22 of the bolt 12 extends through a circular opening 23 in the bracket 20. A pair of nuts 24 and 26 on the stem 22 are tightened against the bracket 20 to retain the bolt 12 in place. The bolt 12 can be relocated relative to the bracket 20 and the throttle linkage by loosening the two nuts 24 and 26, moving the stem 22 through the opening 23 in the bracket, and retightening both nuts 24 and 26 against the bracket 20. This can be a difficult and time consuming process.

SUMMARY OF THE INVENTION

The present invention comprises an apparatus for controlling the idle speed of an internal combustion engine. The engine has a throttle linkage with a movable control member. The apparatus includes a bracket, a bolt, a spring and a nut. An electrical coil on the bolt magnetizes the bolt when the coil is energized by electric current.

The bracket is configured to be mounted on the engine at a location spaced from the throttle control member. The bolt has a screw-threaded stem with a non-circular cross section corresponding to a non-circular opening in the bracket. In this configuration, the bolt is movable longitudinally relative to the bracket, but is blocked from rotating relative to the bracket, when the stem is received through the opening.

A spring abutment member is located on the bolt. The spring is compressible between the spring abutment member and a side of the bracket adjacent to the throttle control member. The nut is receivable over the stem in abutment with an opposite side of the bracket.

The invention enables the bolt to be moved relative to the throttle control member quickly and easily. This is because the bolt can be advanced longitudinally toward the throttle control member under the bias of the spring by rotating the nut on the stem in one direction, and can be retracted longitudinally from the throttle control member against a bias of the spring by rotating the nut on the stem in the opposite direction.

DESCRIPTION OF A PREFERRED EMBODIMENT

Figure 1:
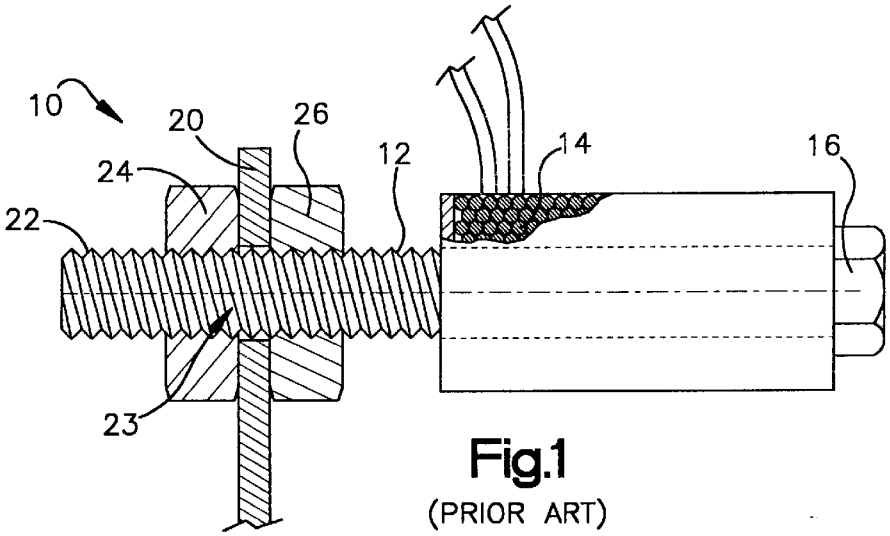
Fig.1 (PRIOR ART)
FIG. 1 shows parts of an idle speed control assembly known in the art.
Figure 2:
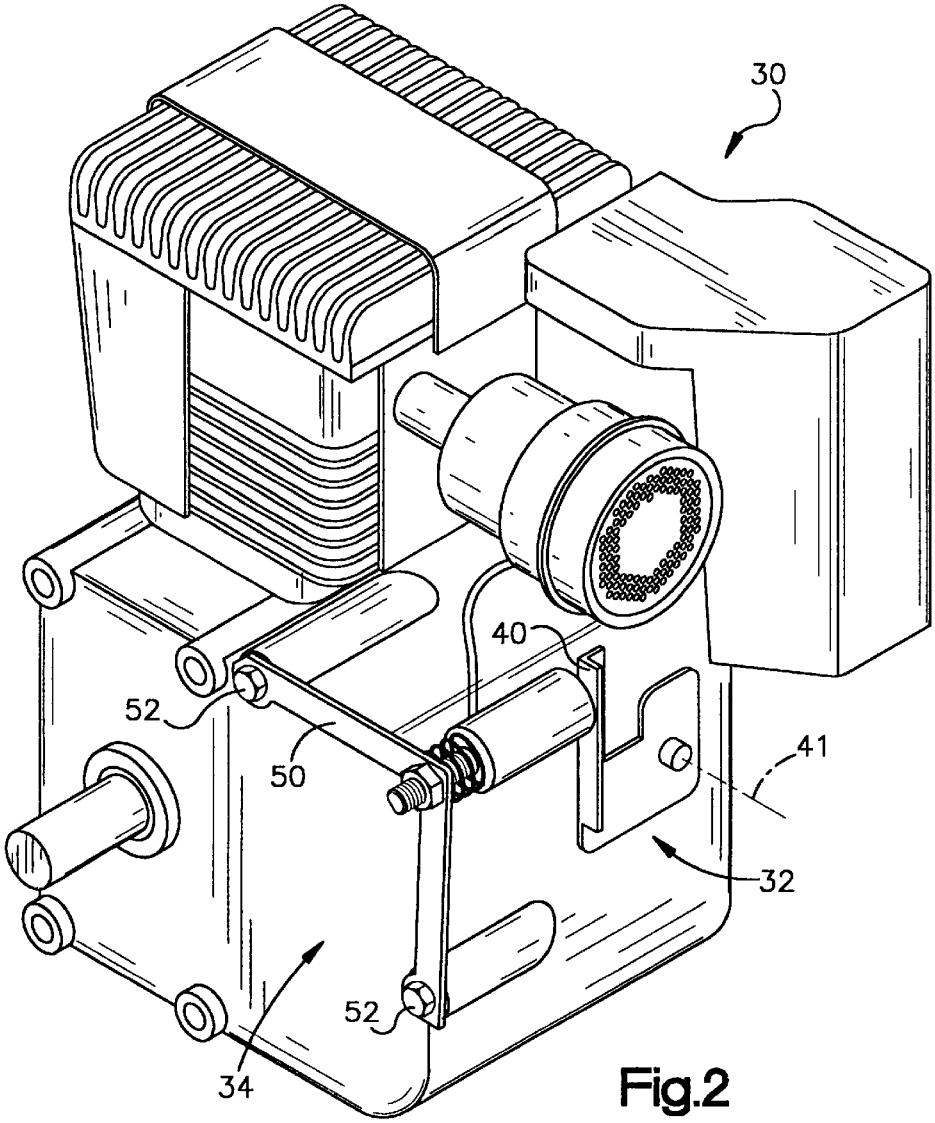
FIG. 2 is a schematic view of an engine equipped with an idle speed control assembly comprising a preferred embodiment of the invention.

As shown schematically in FIG. 2, a preferred embodiment of the present invention includes an internal combustion engine 30. The engine 30 has a throttle linkage 32 (shown partially) which is acuatable to vary the engine speed in accordance with operator input. As known in the art, the throttle linkage 32 is movable into and out of an idle condition in which it maintains the engine speed at its lowest operating level. The engine 30 further has an idle speed control assembly 34 which is actuatable to switch the throttle linkage 32 into and out of the idle condition. Moreover, the idle speed control assembly 34 cooperates with the throttle linkage 32 to define the idle condition of the throttle linkage 32, and thereby to define the idle speed of the engine 30.

The throttle linkage 32 includes a movable throttle control member 40 which is known as a flag. The speed of the engine 30 varies in accordance with movement of the flag 40 pivotally about an axis 41. Specifically, the throttle linkage 32 in the preferred embodiment of the invention decreases the engine speed upon movement of the flag 40 pivotally about the axis 41 in a counter-clockwise direction, as viewed in FIG. 3.

Figure 4:
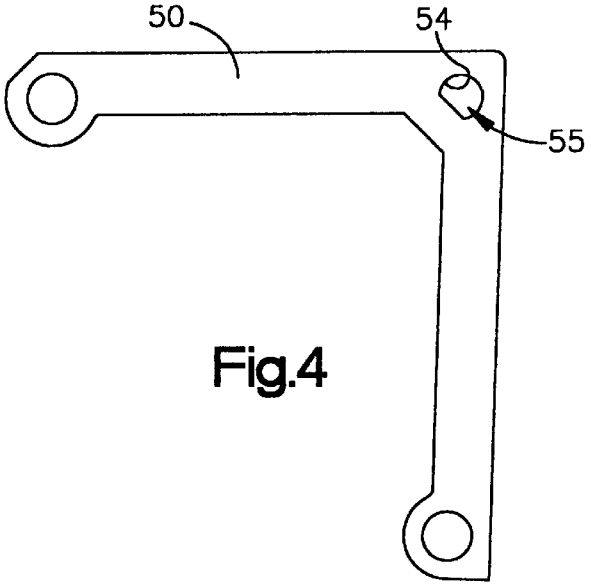
FIG. 4 is an enlarged front view of a part shown in FIG. 2.

The control assembly 34 includes a rigid metal bracket 50. The bracket 50 is mounted on the engine 30 at a location spaced from the flag 40. In the preferred embodiment of the invention, the bracket 50 is a V-shaped part and is fixed to the engine 30 by fasteners 52 at its opposite ends. An inner edge surface 54 (FIG. 4) of the bracket 50 defines a D-shaped opening 55 at the apex of the bracket 50.

Figure 3:
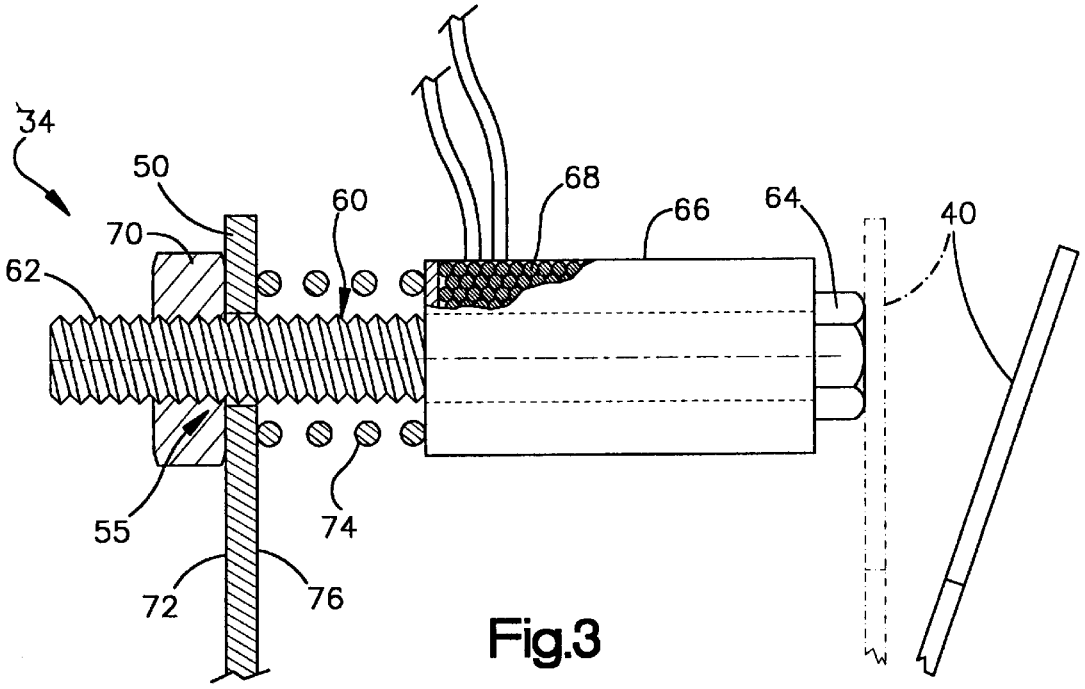
FIG. 3 is an enlarged side view of parts shown in FIG. 2.

The control assembly 34 further includes a bolt 60 projecting longitudinally from the bracket 50 toward the flag 40. The screw-threaded stem portion 62 of the bolt 60 extends through the opening 55 in the bracket 50. The head 64 of the bolt 60 is located closely adjacent to the flag 40. A cylindrical housing 66 on the stem 62 contains an electrical coil 68 which, when energized by electric current, magnetizes the bolt 60. When the bolt 60 is magnetized, the force of the resulting magnetic field moves the flag 40 into contact with the bolt head 64. As indicated in FIG. 3, the flag 40 is thus moved pivotally about the axis 41 in the counter-clockwise direction. The engine speed is decreased by a corresponding amount. In this manner, the lowest engine operating speed attainable by actuation of the throttle linkage 32, i.e., the idle speed, is defined by the position of the bolt head 64 within the range of movement of the flag 40.

Figure 5:
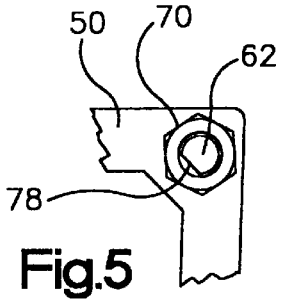
FIG. 5 is a view taken on line 5—5 of FIG. 3.

In accordance with the invention, the control assembly 34 is configured such that the position of the bolt head 64, and hence the idle speed of the engine 30, can be set or varied from a specified setting simply by rotating a single nut 70 on the stem 62. The nut 70 is received on the stem 62 in abutment with the side 72 of the bracket 50 facing away from the flag 40. A spring 74 is compressed between the housing 66 and the side 76 of the bracket 50 facing the flag 40. The housing 68 acts as a spring abutment member which transmits the force of the spring 74 to the bolt head 64. This causes the spring 74 to urge the bolt 60 longitudinally to the right, as viewed in FIG. 2, toward the flag 40. A flat 78 (FIG. 5) provides the stem 62 with a D-shaped cross section corresponding to the cross section of the opening 55 (FIG. 3) in the bracket 50. The stem 62 is thus movable longitudinally through the opening 55 but is blocked from rotating in the opening 55. Accordingly, when the nut 70 is rotated in the counter-clockwise direction, as viewed in FIG. 4, the bolt 60 is advanced longitudinally toward the flag 40 under the bias of the spring 74. When the nut 70 is rotated oppositely, the bolt 60 is retracted longitudinally from the flag 40 against the bias of the spring 74.

The present invention has been described with reference to a preferred embodiment. Those skilled in the art will perceive improvements, changes and modifications as taught by the foregoing description. Such improvements, changes and modifications are intended to be within the scope of the claims.

We claim:

1. An apparatus for controlling the idle speed of an internal combustion engine having a throttle linkage with a movable throttle control member, said apparatus comprising:

a bracket configured to be mounted on the engine, said bracket having a non-circular opening;

a bolt having a screw-threaded stem with a non-circular cross section corresponding to said non-circular opening such that said bolt is movable longitudinally, but is blocked from rotating, relative to said bracket when said stem is received through said opening;

an electrical coil configured to magnetize said bolt when energized by electric current;

a spring abutment member on said bolt;

a spring compressible between said spring abutment member and a side of said bracket adjacent to said throttle control member; and a screw-threaded nut receivable over said stem in abutment with an opposite side of said bracket, whereby said bolt can be advanced longitudinally toward said throttle control member under the bias of said spring by rotating said nut on said stem in one direction, and can be retracted longitudinally from said throttle control member against a bias of said spring by rotating said nut on said stem in the opposite direction.

2. An apparatus as defined in claim 1 wherein said spring abutment member comprises a housing containing said coil.

3. An apparatus as defined in claim 2 wherein said non-circular opening and said non-circular cross section are D-shaped.

4. An apparatus comprising:

an internal combustion engine having a throttle linkage with a movable throttle control member;

a bracket mounted on said engine, said bracket having a non-circular opening;

a bolt having a screw-threaded stem extending through said non-circular opening, said stem having a corresponding non-circular cross section such that said bolt is movable longitudinally, but is blocked from rotating, relative to said bracket;

an electrical coil configured to magnetize said bolt when energized by electric current;

a spring abutment member on said bolt;

a spring compressed between said spring abutment member and a side of said bracket adjacent to said throttle control member; and a screw-threaded nut received over said stem in abutment with an opposite side of said bracket.

5. An apparatus as defined in claim 4 wherein said spring abutment member comprises a housing containing said coil.

6. An apparatus as defined in claim 5 wherein said non-circular opening and said non-circular cross section are D-shaped.

* * * * *

UNITED STATES PATENT AND TRADEMARK OFFICE

CERTIFICATE OF CORRECTION

PATENT NO : 6,019,084

DATED : February 1, 2000

INVENTOR(S) : Haynes and Brandon

It is certified that error appears in the above-identified patent and that said Letters Patent are hereby corrected as shown below:

On the title page,

ASSIGNEE: Campbell Hausfeld [;] / Scott Fetzer Company

Signed and Sealed this

First Day of August, 2000

*Attest:*

Q. TODD DICKINSON

*Attesting Officer*

*Director of Patents and Trademarks*